United States Patent [19]

Radulski et al.

[11] Patent Number: 4,690,539

[45] Date of Patent: Sep. 1, 1987

[54] TRANSFER APPARATUS

[75] Inventors: Charles A. Radulski, Macedon; Henry R. Till, Rochester, both of N.Y.

[73] Assignee: Xerox Corporation, Stamford, Conn.

[21] Appl. No.: 867,129

[22] Filed: May 27, 1986

[51] Int. Cl.[4] ..... G03G 15/01; G03G 15/14

[52] U.S. Cl. ..... 355/3 TR; 355/4; 355/10; 355/15; 118/645; 34/16; 34/92

[58] Field of Search ..... 355/4, 10, 3 TR, 3 DD, 355/14 TR, 15; 430/44, 48, 117–119; 118/645, 661, 662; 34/16, 18, 92

[56] References Cited

U.S. PATENT DOCUMENTS

| | | | |
|---|---|---|---|
| 2,990,278 | 6/1961 | Carlson | 355/3 TR |
| 3,838,919 | 10/1974 | Takahashi | 355/4 |
| 3,893,761 | 7/1975 | Buchan et al. | 355/3 TR |
| 4,144,808 | 3/1979 | Iwasa | 355/3 TR |
| 4,183,658 | 1/1980 | Winthaegen | 355/3 BE |
| 4,518,976 | 5/1985 | Tarumi et al. | 355/3 TR |
| 4,531,825 | 7/1985 | Miwa et al. | 355/3 TR |
| 4,541,709 | 9/1985 | Kampschreur | 355/3 TR |
| 4,542,978 | 9/1985 | Tarumi et al. | 355/3 TR |
| 4,556,309 | 12/1985 | Weber et al. | 355/3 TR |

FOREIGN PATENT DOCUMENTS

| | | | |
|---|---|---|---|
| 165173 | 12/1981 | Japan . | |
| 77467 | 5/1984 | Japan . | |
| 125766 | 7/1984 | Japan | 355/4 |

OTHER PUBLICATIONS

*Xerox Disclosure Journal*, "Color Xerography with Intermediate Transfer", vol. 1, No. 7, Jul. '76, p. 29.

*Primary Examiner*—R. L. Moses

*Attorney, Agent, or Firm*—H. Fleischer; J. E. Beck; R. Zibelli

[57] ABSTRACT

An apparatus in which a plurality of liquid images are transferred from a photoconductive member to a copy sheet. The liquid images, which include a liquid carrier having toner particles dispersed therein, are attracted from the photoconductive member to an intermediate web. A substantial amount of the liquid carrier is removed from the intermediate web and the toner particles are secured thereon. Thereafter, another liquid image having toner particles of a different color from the toner particles of the first liquid image, is attracted to the intermediate member. Once again, the liquid carrier material is removed from the web and the toner particles of the second liquid image are secured thereon. Thereafter, all of the toner particles are transferred from the intermediate member to the copy sheet, in image configuration.

26 Claims, 2 Drawing Figures

TRANSFER APPARATUS

Figure 1:
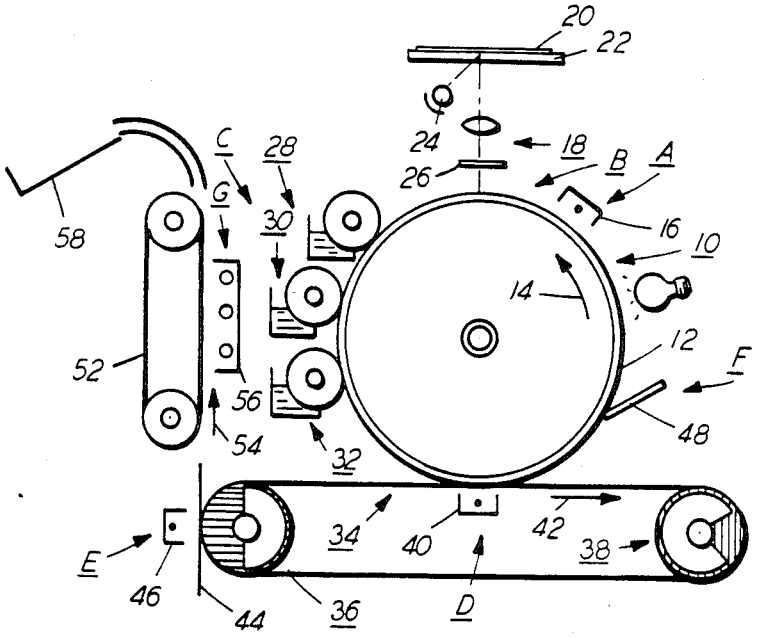

This invention relates generally to an electrostatographic printing machine, and more particularly concerns an apparatus for transferring a plurality of liquid images having at least a liquid carrier with toner particles dispersed therein from a photoconductive member to a copy sheet.

In electrophotographic printing, a charged photoconductive member is exposed to a light image of an original document. The irradiated areas of the photoconductive surface are discharged to record an electrostatic latent image thereon corresponding to the informational areas contained within the original document. Generally, the electrostatic latent image is developed by bringing a dry developer mixture into contact therewith. A dry developer mixture usually comprises carrier granules having toner particles adhering triboelectrically thereto. Toner particles are attracted from the carrier granules to the latent image forming a toner powder image thereon. Alternatively, a liquicd developer material may be employed. The liquid developer material includes a liquid carrier having toner particles dispersed therein. The liquid developer material is advanced into contact with the electrostatic latent image and the toner particles are deposited therein in image configuration. After the toner particles have been deposited on the photoconductive surface in image configuration, it is transferred to a copy sheet. Generally, when a liquid developer material is employed the copy sheet is wet with both the toner particles and the liquid carrier. Thus, it becomes necessary to remove the liquid carrier from the copy sheet. This may be accomplished by drying the copy sheet prior to fusing the toner particles thereto or relying upon the fusing process to permanently fuse the toner particles to the copy sheet as well as vaporizing the liquid carrier adhering thereto. In both liquid and dry development, the toner particles must be fused to the copy sheet so as to form a permanent image thereon.

With the advent of multicolor electrophotographic printing, the foregoing process is repeated a plurality of cycles. In multicolor electrophotographic printing, the light image is filtered to record an electrostatic latent image on the photoconductive surface corresponding to one color of the original document. An electrostatic latent image is then developed with toner particles complimentary in color to the filtered light image. The toner image is then transferred to the copy sheet. The foregoing process is repeated for successively different colored light images. After all of the toner images have been transferred to the copy sheet, the resultant toner image is fused thereto. In a liquid development system, the requirement to develop and transfer a plurality of liquid images to the copy sheet frequently results in excessive liquid carrier being transferred thereto. Clearly, it is undesirable to transfer any liquid carrier to the copy sheet let alone an excessive amount.

In dry electrophotographic printing machines, multicolor copying has been achieved with the utilization of an intermediate roller. In devices of this type, successive toner powder images are transferred, in superimposed registration with one another, from the photoconductive drum to an intermediate roller. One such system is described in U.S. Pat. No. 3,957,367 issued to Goel in 1976. In this system, successive toner powder images are transferred from the photoconductive surface to an intermediate roller in superimposed registration with one another and fused thereon. The fused multicolored image is then transferred to the copy sheet. Other systems employ three photoconductive drums, one for each of the toner powder images being developed. U.S. Pat. No. 3,392,667 issued Cassel et al. in 1968 and U.S. Pat. No. 3,399,611 issued Luscher in 1968 describe printing machines of this type. However, liquid multicolor electrophotographic printing machines have a problem in transferring liquid images, in superimposed registration, with one another onto either an intermediate member or a copy sheet. In either case, the liquid images tend to smear and intermingle with one another distorting and blurring the resultant multicolor copy. Furthermore, the liquid images may transfer back to the photoconductive surface. However, intermediate members have been employed in liquid printing machines. The following disclosures appear to be relevant:

U.S. Pat. No. 4,183,658
Patentee: Winthaegen
Issued: Jan. 15, 1980
U.S. Pat. No. 4,556,309
Patentee: Weber et al.
Issued: Dec. 3, 1985

The relevant portions of the foregoing patents may be briefly summarized as follows:

Winthaegen discloses an electrostatic latent image recorded on a photoconductive belt which is developed with toner particles. The toner powder image is transferred to an intermediate support belt and heated thereon so as to become sticky. The sticky toner powder image is then transferred to a copy sheet.

Weber et al. describes an apparatus for producing color-proofs electrophotographically. A charged photoconductive member is exposed to radiant energy through a color separated transparency. The latent image is developed or toned. The toner image is transferred to an intermediate or offset medium. The toning or developing station includes four self-contained toning modules one for each liquid toner of the four primary toner colors, yellow, cyan, black and magenta. The liquid toner contains toner particles dispersed in an electrically insulating fluid dispersant, such as a hydrocarbon. The toner image is transferred from the intermediate member to the copy sheet. Successive color separated transparencies are substituted, in sequence, to form the finished color proof.

In accordance with one aspect of the present invention, there is provided an apparatus for transferring a plurality of liquid images having at least a liquid carrier with toner particles dispersed therein from a member to a copy sheet. The apparatus includes an intermediate member positioned closely adjacent to the member. Means attract one of the liquid images from the member to the intermediate member. Means remove substantially all of the liquid carrier from the intermediate member and secure the toner particle on the intermediate member in image configuration. Means transfer toner particles from the intermediate member to the copy sheet in image configuration.

Pursuant to another aspect of the features of the present invention, there is provided a photographic printing machine of the type adapted to have a plurality of liquid images having at least a liquid carrier with toner particles therein formed on a photoconductive member. The printing machine includes an intermediate member positioned closely adjacent to the photoconductive member. Means attract one of the liquid images from the photoconductive member to the intermediate member. Means remove substantially all of the liquid carrier on the intermediate member and secure the toner particles on the intermediate member in image configuration. Means transfer the toner particles from the intermediate member to the copy sheet in image configuration.

Figure 2:
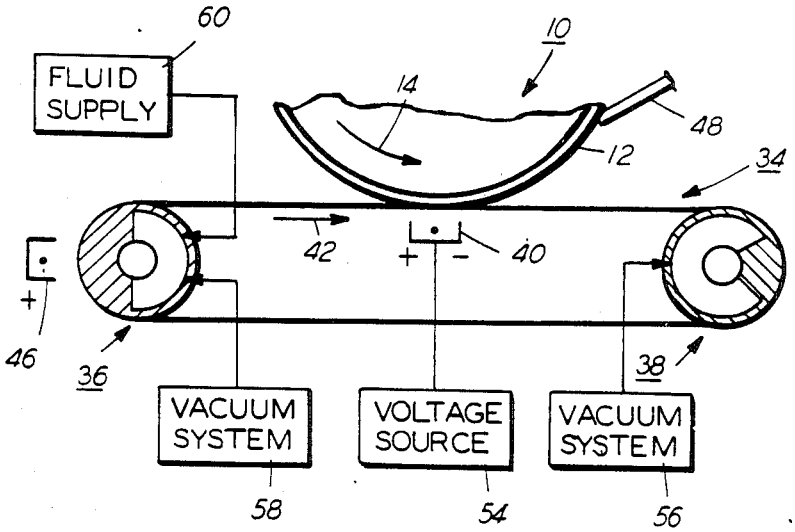

Other aspects of the present invention will become apparent as the following description proceeds and upon reference to the drawings, in which:

FIG. 1 is a schematic elevational view showing an illustrative electrophotographic printing machine incorporating the features of the present invention therein; and FIG. 2 is an elevational view depicting the transfer apparatus used in the FIG. 1 printing machine.

While the present invention will hereinafter be described in connection with a preferred embodiment thereof, it will be understood that it is not intended to limit the invention to that embodiment. On the contrary, it is intended to cover all alternatives, modifications, and equivalents as may be included in the spirit and scope of the invention as defined by the appended claims.

For a general understanding of the features of the present invention, reference is made to the drawings. In the drawings, like reference numerals have been used throughout a designate identical elements. FIG. 1 is a schematic elevational view illustrating an electrophotographic printing machine incorporating the features of the present invention therein. It will become apparent from the following discussion that the apparatus of the present invention is equally well suited for used in a wide variety of printing machines and is not necessarily limited in its application to the particular embodiment shown herein.

Turning now to FIG. 1, the electrophotographic printing machine employs a photoconductive member having a drum 10 mounted rotatably within the printing machine frame. Photoconductive surface 12 is mounted on the exterior circumferential surface of drum 10 and entrained thereabout. A series of processing stations are positioned about drum 10 such that as drum 10 rotates in the direction of arrow 14, it passes sequentially therethrough. Drum 10 is driven at predetermined speed relative to the other machine operating mechanisms by a drive motor. A timing disc mounted in the region of one end of the shaft of drum 10 cooperates with the machine logic to synchronize the various operations with the rotation of drum 10. In this matter, the proper sequence of events is produced at the respective processing stations.

Drum 10 initially rotates photoconductive surface 12 through charging station A. At charging station A, a corona generating device, indicated generally by the reference numeral 16, sprays ions onto photoconductive surface 12 producing a relatively high, substantially uniform charge thereon.

After photoconductive surface 12 is charged to a substantially uniform potential, drum 10 rotates the charged portion of photoconductive surface 12 to exposure station B. At exposure station B, a light image of an original document is projected onto the charged portion of photoconductive surface 12. Exposure station B includes a moving lens system generally designated by the reference numeral 18. An original document 20 is positioned face down upon a generally planar, substantially transparent platen 22. Lamps 24 are adapted to move in a timed relation with lens 18 to scan successive incremental areas of original document 20. In this manner, a flowing light image of original document 20 is projected through filter mechanism 26. This forms a single color light image which irradiates the charged portion of photoconductive surface 12 to selectively discharge the charge thereon. This records an electrostatic latent image on photoconductive surface 12 corresponding to a single color of the original document. One skilled in the art will appreciate that a laser system or an ionographic system may be employed in lieu of a light lens system to record the electrostatic latent image.

After exposure, drum 10 rotates the single color electrostatic latent image recorded on photoconductive surface 12 to development station C. Development station C includes three individual developer units, generally indicated by the reference numerals 28, 30 and 32, respectively. These three developer units includes a roller adapted to advance a liquid developer material into contact with the electrostatic latent image recorded on photoconductive surface 12. By way of example, the liquid developer material comprises an insulating liquid carrier material made from an aliphatic hydrocarbon, largely decane, which is manufactured by the Exxon Corporation under the trademark isopar having toner particles dispersed therein. Preferably, the toner particles are made predominantly from a pigmented material, such as a suitable resin. A suitable liquid developer material is described in U.S. Pat. No. 4,582,774 issued to Landa in 1986, the relevant portions thereof being hereby incorporated into the present application. The distinctions between each of the developer units resides primarily in the fact that they contain differently colored toner particles therein. For example, developer unit 28 may contain yellow toner particles, developer unit 30, magenta toner particles, and developer unit 32, cyan toner particles. Each developer unit is activated sequentially to deposit the liquid developer material containing the toner particles complimentary in color to the filtered light image, on the electrostatic latent image. Thus, an electrostatic latent image formed from a green filtered light image is developed by depositing a liquid developer material having magenta toner particles therein. Similarly, latent images formed from blue and red light images are developed with liquid developer materials containing yellow and cyan toner particles therein, respectively. One skilled in the art will appreciate that a fourth developer unit containing an insulating liquid developer material having black toner particles dispersed therein may also be employed. The developed electrostatic latent image is transported on drum 10 to transfer station D.

At transfer station D, the developed liquid image is electrostatically transferred to an intermediate member or a belt, indicated generally by the reference numeral 34. Belt 34 is entrained about spaced rollers, indicated generally by the reference numerals 36 and 38, respectively. Belt 34 rotates in synchronism with drum 10 and the exposure system so that successive images may be transferred to the same region of belt 34. Thus, a plurality of liquid images may be transferred, in superimposed registration with one another, to belt 34. A corona generating device, indicated by the reference numeral 40, sprays ions to the backside of belt 34 to attract successive developed images thereto in superimposed registration with one another. Alternatively, an electrically biased roll, positioned behind and adjacent belt 34 may be employed to attract the developed image thereto. As belt 10 rotates in the direction of arrow 42, it passes around roll 38. Roll 38 is porous and coupled to a vacuum system. As the image passes over roll 38, the image solid/liquid ratio is modified by drawing the liquid carrier from the image area. In addition, the toner particles are drawn to the surface of belt 34 and may partially embed therein. This allows the next successive image to be transferred, in superimposed registration with the first image, without disruption or disturbance of the first image. Thereafter, the first image returns to transfer station B where corona generating device 40 sprays ions onto the backside of belt 34 to attract the next developed liquid image from photoconductive surface 12 thereto in superimposed registration with the first image. Once again, the first image with the second image transferred thereto in superimposed registration passes over roller 38. A vacuum is applied and the liquid carrier material drawn off and the toner particles from the second image are also drawn to the surface of belt 34 and may partially embed in belt 34. The foregoing processes are repeated for the third and final developed liquid image. After all of the liquid images have been transferred to belt 34 and the liquid carrier removed therefrom with the toner particles on the belt 34, roll 36, which is coupled to a fluid source, furnishes liquid carrier to belt 34. Roll 36 also has a vacuum applied thereto to assistance in the removal of the liquid carrier transferred to belt 34 during the transfer step. During the transfer of the superimposed toner particles to a copy sheet 44, roll 36 furnishes liquid carrier to belt 34. The liquid carrier being furnished to the backside of belt 34 at transfer station E forms a low viscosity zone near the image/belt interface boundary. This low viscosity zone allows the superimposed toner particles to be transferred to copy sheet 44 when corona generating device 46 sprays ions onto the backside thereof. After the superimposed toner particles have been transferred from belt 34 to copy sheet 44, in image configuration, belt 34 with liquid carrier thereon advances once again to transfer station D. At this time, the polarity of the power supply exciting corona generating device 40 is reversed so as to spray ions of an opposite polarity onto the backside of belt 34 repelling the liquid carrier therefrom onto photoconductive surface 12 of drum 10. This liquid carrier material now adhering to photoconductive surface 12 of belt 10 facilitates cleaning of residual particles therefrom. Alternatively, a cleaning system may be utilized to remove the residual liquid carrier material adhering to the surface of belt 34.

With continued reference to FIG. 1, the liquid carrier and residual particle adhering to photoconductive surface 12 are removed therefrom by a flexible resilient blade 48 located at cleaning station F. Thereafter, lamp 50 is energized to discharge any residual charge on photoconductive surface 12 for the next successive imaging cycle.

After the superimposed toner particles are transferred to copy sheet 44 at transfer station D, the copy sheet advances on conveyor 52 through fusing station G. Fusing station G includes a radiant heater 54 which radiates sufficient energy to permanently fuse the toner particles to copy sheet 44 in image configuration. Conveyor belt 52 advances the copy sheet in the direction of arrow 54 through radiant fuser 56 to catch tray 58. When copy sheet 44 is located in catch tray 58, it may be readily removed therefrom by the machine operator.

The foregoing describes generally the operation of the electrophotographic printing machine including the transfer apparatus of the present invention therein. The detailed structure of the transfer apparatus will be described with reference to FIG. 2.

Referring now to FIG. 2, corona generating device 40 is energized by voltage source 54. Energization of corona generating device 40 sprays ion onto the backside of belt 34 to attract successive developed liquid images thereto. After the first liquid image is transferred to belt 34, it passes around roller 38 which is porous. Vacuum system 56 is then energized to remove the liquid carrier material and to draw the toner particles onto the surface of belt 34. The toner particles may be partially embedded in the surface of belt 34. As the developed image passes over roller 36, vacuum system 58 is also energized to remove any residual liquid carrier adhering to belt 34. Thereafter, voltage source 54 once again energizes corona generating device 40 to transfer the next successive developed image to belt 34 in superimposed registration with the toner particles secured thereon. The foregoing process is repeated for the second liquid image and for the third liquid image. At this time, all of the images have been transferred to belt 34 in superimposed registration with one another. After all of the images have been transferred to belt 34 in superimposed registration with one another, vacuum system 58 is deenergized and the pump associated with fluid supply 60 is energized. Roller 36 is also porous in order to enable vacuum system 58 and fluid system 60 to operate satisfactorily. At this time, corona generating device 46 is energized to spray ions onto the backside of copy sheet 44. In addition, the pump associated with fluid supply 60 is energized to furnish liquid carrier material onto the backside of belt 34. This forms a low viscosity zone at the interface between toner particles and belt 34. The ions sprayed onto the backside of copy sheet 44 attract the toner particles to the copy sheet, in image configuration. This forms a composite color image corresponding to the information contained within the original document. After the toner particles are transferred to the copy sheet, additional liquid carrier is furnished to the backside of belt 34. Voltage source 54 has its polarity reversed so that the ions sprayed onto the backside of belt 34 by corona generating device 40 are of opposite polarity to those previously sprayed thereon for transfer. These ions repel the liquid carrier material and any residual toner particles from belt 34 to photoconductive surface 12. As drum 10 rotates in the direction of arrow 14, the liquid carrier material and any residual toner particles adhering to the photoconductive surface 12 pass into contact with the free edge of blade 48. Blade 48 removes the liquid carrier material and any residual toner particles dispersed therein from photoconductive surface 12. This cleans the surface of photoconductive surface 12 for the next successive imaging cycle. By way of example, belt 34 is made from a rough or smooth, substantially porous, absorbent web. Exemplary materials are any polymers which are flexible and highly insulating. A typical belt material is a polyester web such as a polyethylene terephthalate available from E. I. du Pont de Nemours & Co., Inc. under the tradename Mylar or any other polypropylene materials.

In recapitulation, it is clear that successive liquid images are transferred to an intermediate belt where the liquid material is removed therefrom leaving only the toner particles adhering thereto in image configuration. The differently colored toner particles are superimposed over one another and may partially embed in the surface of belt 34 to prevent smearing and distortion as successive layers thereof are transferred to belt 34 from photoconductive surface 12. These superimposed toner particles are then transferred to the copy sheet, in image configuration, to form a color copy.

It is, therefore, apparent that there has been provided, in accordance with the present invention, an apparatus for transferring successive liquid images to an intermediate belt and then transferring the resultant toner image to a copy sheet, in image configuration, to form a multicolor copy. This apparatus fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications, and variations as fall within the spirit and broad scope of the appended claims.

We claim:

1. An apparatus for transferring a plurality of liquid images having at least a liquid carrier with toner particles dispersed therein from a member to a copy sheet, including:

an intermediate member positioned closely adjacent to the member;

means for attracting one of the liquid images from the member to said intermediate member;

means for removing a substantial portion of the liquid carrier on said intermediate member and securing the toner particles on said intermediate member in image configuration; and intermediate member in image configuration; and means for transferring toner particles from said intermediate member to the copy sheet in image configuration.

2. An apparatus according to claim 1, wherein the toner particles secured on the surface of said intermediate member may be partially embedded therein.

3. An apparatus according to claim 2, wherein:

said attracting means attracts another liquid image to said intermediate member wherein a region thereof may be at least partially superimposed over the first mentioned one of the liquid images attracted thereto;

said removing means removes a substantial portion of the liquid carrier deposited on said intermediate member by the other liquid image and secures the toner particles from the other liquid image on said intermediate member; and said transferring means transfers toner particles of the first mentioned liquid image and toner particles of the other liquid image substantially simultaneously from said intermediate member to the copy sheet.

4. An apparatus according to claim 3, wherein the toner particles of the first mentioned liquid image and the toner particles of the other liquid image are of different colors.

5. An apparatus according to claim 4, wherein said attracting means repels residual toner particles adhering to said intermediate member back onto said member after said transferring means transfers the toner particles from said intermediate member to the copy sheet.

6. An apparatus according to claim 5, further including means for cleaning the residual toner particles from the member.

7. An apparatus according to claim 6, wherein said intermediate member is made from a web.

8. An apparatus according to claim 7, wherein said attracting means includes a corona generator positioned adjacent said web on the side thereof opposed from the member.

9. An apparatus according to claim 8, wherein said attracting means includes means for energizing said corona generator to a first polarity for attracting the liquid images from the member to said web and to a second polarity opposite to the first polarity to repel the residual toner particles from said web to the member.

10. An apparatus according to claim 9, wherein said transferring means includes:

a corona generator positioned adjacent said web on the side thereof opposed from the copy sheet; and means for adding liquid carrier to said web to form a low viscosity zone facilitating the transfer of the toner particles from said web to the copy sheet.

11. An apparatus according to claim 10, wherein said removing means includes a vacuum roll arranged to have a portion of said web entrained thereover and adapted to generate a partial vacuum through the portion of said web having the liquid image attracted thereto to remove a substantially portion of the liquid carrier adhering thereto.

12. An apparatus according to claim 11, wherein said adding means includes a fluid addition roll arranged to have a portion of said web entrained thereover and adapted to add liquid carrier to said web.

13. An apparatus according to claim 12, wherein said cleaning means includes a cleaning blade having the free end portion thereof contacting said member to remove residual toner particles therefrom.

14. An electrophotographic printing machine of the type adapted to have a plurality of liquid images having at least a liquid carrier with toner particles dispersed therein formed on a photoconductive member, including:

an intermediate member positioned closely adjacent to the photoconductive member;

means for attracting one of the liquid images from the photoconductive member to said intermediate member;

means for removing a substantial portion of the liquid carrier on said intermediate member and securing the toner particles on said intermediate member in image configuration; and means for transferring toner particles from said intermediate member to the copy sheet in image configuration.

15. An apparatus according to claim 14, wherein the toner particles secured on the surface of said intermediate member may be partially embedded therein.

16. A printing machine according to claim 15, wherein:

said attracting means attracts another liquid image to said intermediate member wherein a region thereof may be at least partially superimposed over the first mentioned one of the liquid images attracted thereto;

said removing means removes a substantial portion of the liquid carrier deposited on said intermediate member by the other liquid image and secures the toner particles from the other liquid image on said intermediate member; and said transferring means transfers toner particles of the first mentioned liquid image and toner particles of the other liquid image substantially simultaneously from said intermediate member to the copy sheet.

17. A printing machine according to claim 16, wherein the toner particles of the first mentioned liquid image and the toner particles of other liquid image are of different colors.

18. A printing machine according to claim 17, wherein said attracting means repels residual toner particles adhering to said intermediate member back onto said photoconductive member after said transferring means transfers the toner particles from said intermediate member to the copy sheet.

19. A printing machine according to claim 18, further including means for cleaning the residual toner particles from the photoconductive member.

20. A printing machine according to claim 19, wherein said intermediate member is made from a web.

21. A printing machine according to claim 20, wherein said attracting means includes a corona generator positioned adjacent said web on the side thereof opposed from the photoconductive member.

22. A printing machine according to claim 21, wherein said attracting means includes means for energizing said corona generator to a first polarity for attracting the liquid images from the photoconductive member to said web and to a second polarity opposite to the first polarity to repel the residual toner particles from said web to the photoconductive member.

23. A printing machine according to claim 22, wherein said transferring means includes:

a corona generator positioned adjacent said web on the side thereof opposed from the copy sheet; and means for adding liquid carrier to said said web to form a low viscosity zone facilitating the transfer of the toner particles from said web to the copy sheet.

24. A printing machine according to claim 23, wherein said removing means includes a vacuum roll arranged to have a portion of said web entrained thereover and adapted to generate a partial vacuum to remove a substantial portion of the liquid carrier on said web.

25. A printing machine according to claim 24, wherein said adding means includes a fluid addition roll arranged to have a portion of said web entrained thereover and adapted to add liquid carrier to said web.

26. A printing machine according to claim 25, wherein said cleaning means includes a cleaning blade having the free end portion thereof contacting said member to remove residual toner particles therefrom.

* * * * *